United States Patent [19]

Terauchi

[11] 4,411,604

[45] Oct. 25, 1983

[54] SCROLL-TYPE FLUID DISPLACEMENT APPARATUS WITH CUP SHAPED CASING

[75] Inventor: Kiyoshi Terauchi, Isesaki, Japan

[73] Assignee: Sanden Corporation, Gunma, Japan

[21] Appl. No.: 260,826

[22] Filed: May 5, 1981

[30] Foreign Application Priority Data

May 7, 1980 [JP] Japan ..... 55-59461

[51] Int. Cl.[3] ..... F01C 1/02; F01C 19/00; F01C 21/10

[52] U.S. Cl. ..... 418/55; 418/149

[58] Field of Search ..... 418/55, 57, 59, 149

[56] References Cited

U.S. PATENT DOCUMENTS

| | | | |
|---|---|---|---|
| 2,306,632 | 12/1942 | McCormack | 418/47 |
| 3,200,752 | 8/1965 | Clark et al. | 418/96 |
| 3,359,913 | 12/1967 | Halsey | 418/149 |
| 3,515,167 | 6/1970 | Svenson | 137/565 |
| 3,924,977 | 12/1975 | McCullough | 418/55 |
| 3,994,635 | 11/1976 | McCullough | 418/55 |
| 4,082,484 | 4/1978 | McCullough | 418/55 |
| 4,325,683 | 4/1982 | Miyazawa | 418/55 |

FOREIGN PATENT DOCUMENTS

| | | | |
|---|---|---|---|
| 1132590 | 11/1968 | United Kingdom | 418/149 |

*Primary Examiner*—John J. Vrablik

*Attorney, Agent, or Firm*—Schuyler, Banner, Birch, McKie & Beckett

[57] ABSTRACT

A scroll-type fluid displacement apparatus, in particular, a compressor unit is disclosed. The unit includes a housing comprising of a cup shaped casing and a front end plate member. A fixed scroll member with a first end plate means and a first spiral element is fixedly disposed within the interior of the cup shaped casing by a plurality of screw members screwed from the outside of the cup shaped casing through a fixed member, such as a plurality of legs or annular projection, which is disposed between the end surface of the first end plate means and the inner surface of the cup shaped casing. A seal ring is disposed between an outer peripheral surface of the end plate and the inner surface of the casing. An inner chamber of the casing is thereby partitioned into two chambers by the end plate.

15 Claims, 6 Drawing Figures

FIG. 6
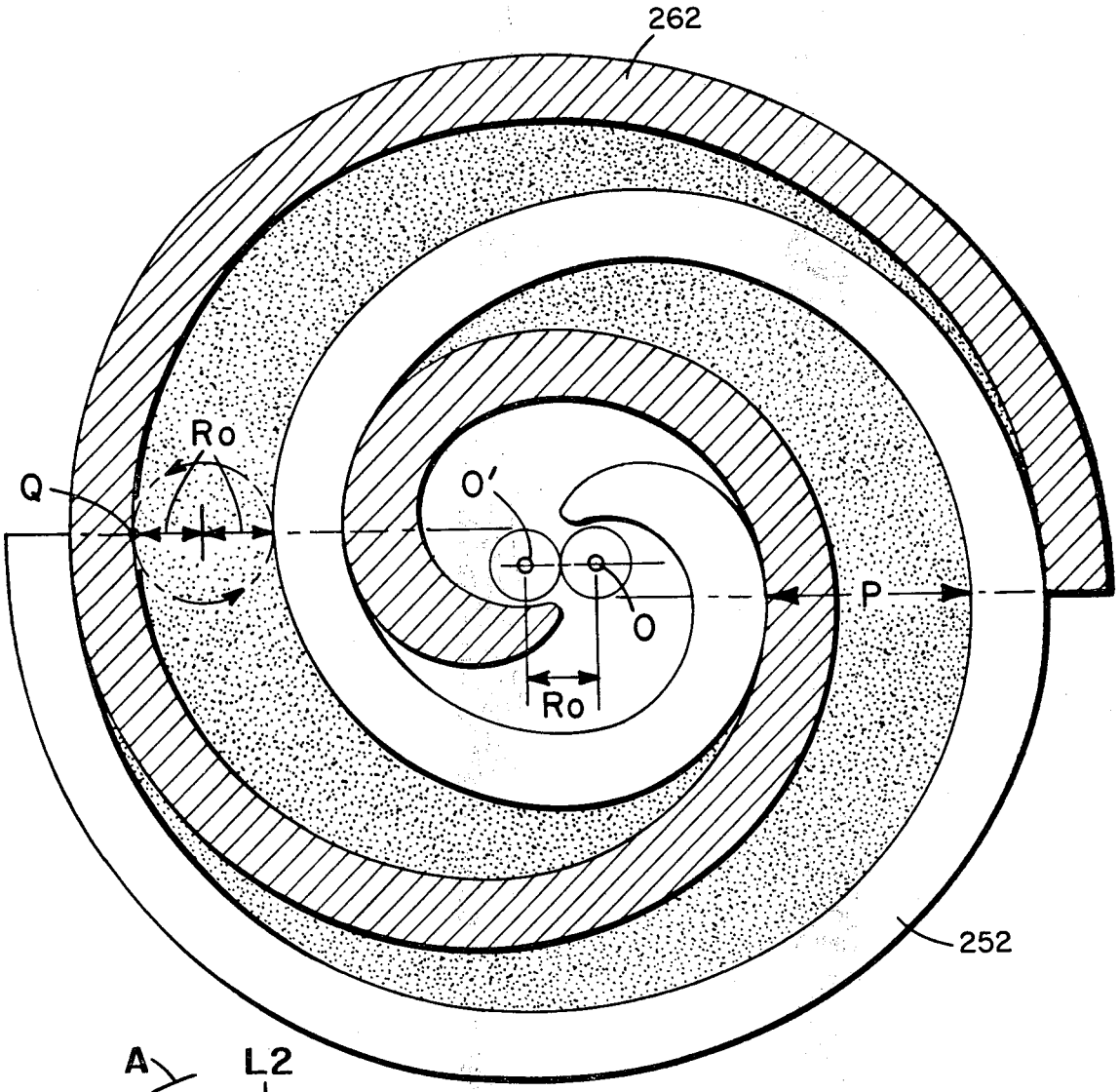
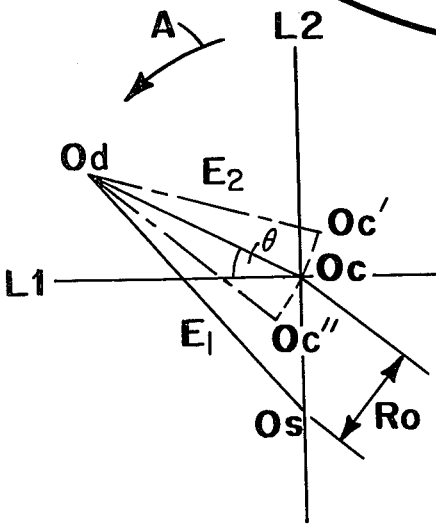
FIG. 4

SCROLL-TYPE FLUID DISPLACEMENT APPARATUS WITH CUP SHAPED CASING

BACKGROUND OF THE INVENTION

This invention relates to a rotary fluid displacement apparatus, and more particularly, to a fluid compressor unit of the scroll-type.

Scroll-type apparatus have been well known in the prior art. For example, U.S. Pat. No. 801,182 discloses a device including two scroll members each having an end plate and a spiroidal or involute spiral element. These scroll members are maintain angularly and radially offset so that both spiral elements interfit to make a plurality of line contacts between spiral curved surfaces thereby to seal off and define at least one pair of fluid pockets. The relative orbital motion of the scroll members shifts the line contact along the spiral curved surfaces and, therefore, the fluid pockets changes in volume. The volume of the fluid pockets increases or decreases dependant on the direction of orbital motion. Therefore, the scroll-type fluid displacement apparatus is applicable to compress, expand or pump fluids.

The scroll-type fluid displacement apparatus is suited for use as a refrigerant compressor of an automobile air-conditioner. Generally, it is desirable that the compressor should be compact and light in weight. In particular, the refrigerant compressor for an automobile air conditioner is necessarily compact in size and light in weight because the compressor is placed in the engine compartment of an automobile. However, the refrigerant compressor which is placed in an automobile must be connected to a magnetic clutch to transmit the rotary output of the engine. The weight of the magnetic clutch is therefore added to the weight of the compressor to thereby increase the total weight of compressor unit.

SUMMARY OF THE INVENTION

It is a primary object of this invention to provide an improvement in fluid displacement apparatus, in particular a compressor unit of scroll type which is compact in size and light in weight.

It is another object of this invention to provide a fluid displacement apparatus, in particular a compressor unit of scroll-type which is simple in construction and configuration, and easy to assemble.

A scroll-type fluid displacement apparatus according to this invention includes a housing having a front end plate member. A fixed scroll member is fixedly disposed within the housing and has a first end plate means from which a first wrap means extends. An orbiting scroll member has a second end plate means from which a second wrap means extends. The first and second wrap means interfit at an angular offset to make a plurality of line contacts to define at least one pair of sealed off fluid pockets. A driving mechanism which includes a drive shaft extends into and is rotatably supported by the front end plate. The driving mechanism effects an orbital motion of the orbiting scroll member by the rotation of the drive shaft while the rotation of the orbiting scroll member is prevented by a rotation preventing mechanism. The fluid pockets changes volume due to the orbital motion of the orbiting scroll member. The housing is comprised of a cup shaped casing and a front end plate member. The front end plate member has an annualar projection formed at one side surface for fitting into an opening portion of the cup shaped casing. The first end plate means of the fixed scroll member is formed with a plurality of legs which axially project from an end surface opposite to the side thereof from which the wrap means extends. The end surface of the legs fit against the inner wall of the cup shaped casing which faces to the front end plate member. The legs are fixed within the cup shaped casing by screws which are screwed from outside surface of the casing into respective legs. Therefore, the fixed scroll member is fixedly disposed within the housing.

First seal ring members are placed between the end surface of legs and the inner wall of the casing for surrounding respective screws, to thereby prevent fluid leakage from inner chamber of the housing to outside of the housing along the screw.

A second seal ring member is placed between the outer peripheral surface of the first end plate means and the inner wall of the casing. Thereby the inner chamber of the housing is partitioned to front and rear chambers by the first end plate means.

It is then possible to use a simple casing formed of press worked steel or aluminum die casting, and the outward form of the casing is made simple and need not form a projecting flange for securing the construction parts disposed within the casing. Therefore, the thickness of the wall of casing will be reduced, and whole size and weight of the compressor unit will be reduced.

In this arrangement of the compressor unit, the drive shaft, driving mechanism, rotation preventing/thrust bearing mechanism and orbiting scroll member are inserted in this order onto the front end plate member and are covered by the cup shaped casing. The fixed scroll member is secured to the cup shaped member by screws, and the compressor unit is easily completed by securing the front end plate member onto the cup shaped casing.

Further objects, features and other aspects of this invention will be understood from the following detailed description of the preferred embodiments of this invention referring to the annexed drawings.

BRIEF DESCRIPTION OF THE DRAWINGS

FIG. 4 is an explanatory diagram of the motion of the eccentrical bushing in the embodiment of FIG. 1;

FIG. 6 is a diagrammatic sectional view illustrating the spiral elements of the fixed and orbiting scroll members.

DETAILED DESCRIPTION OF THE PREFERRED EMBODIMENTS

Figure 1:
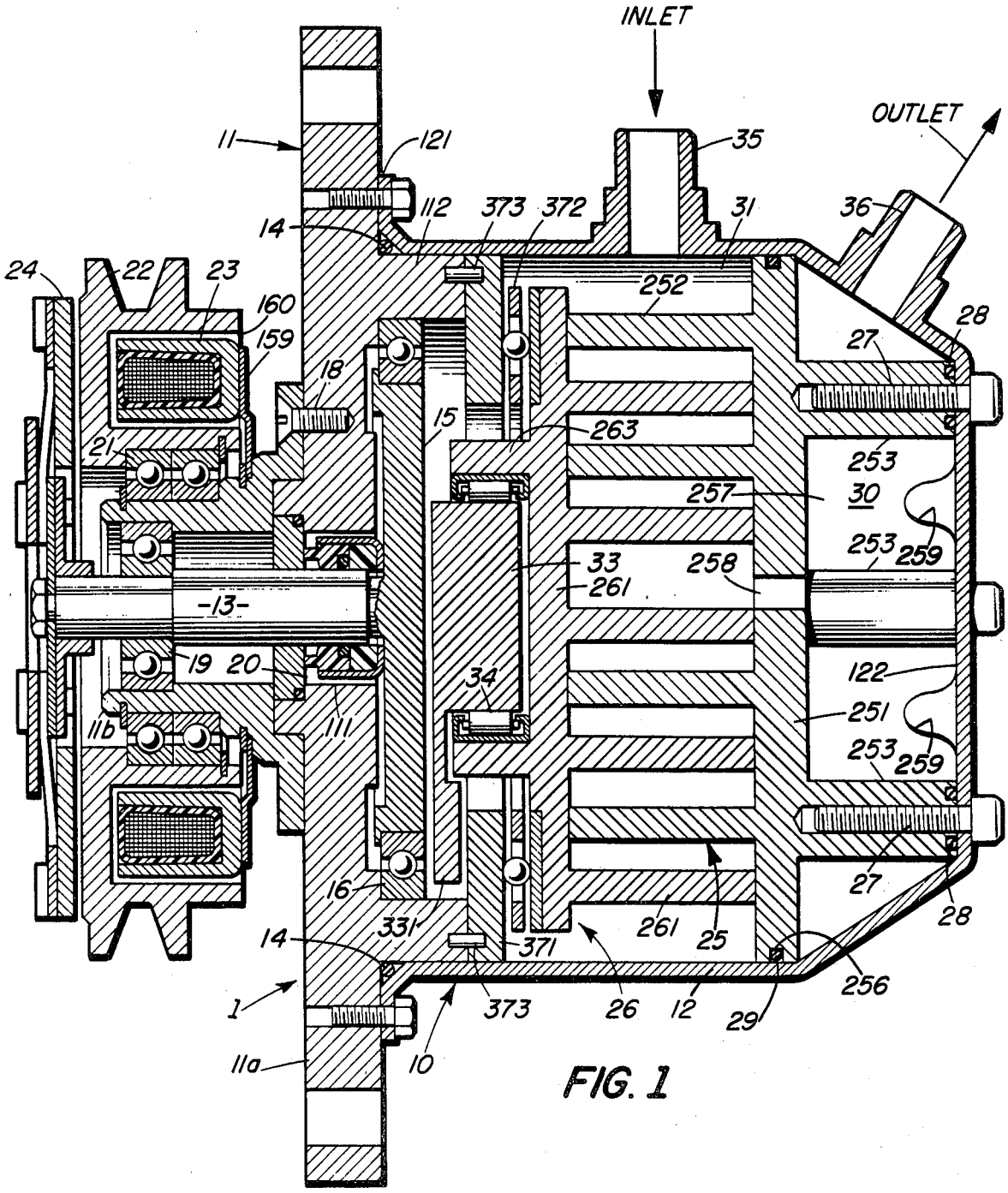
FIG. 1 shows a vertical sectional view of a compressor unit of the scroll-type according to an embodiment of this invention.

Referring to FIG. 1, a fluid displacement apparatus in accordance with the present invention, in particular a refrigerant compressor unit 1 of an embodiment of the present invention is shown. The unit 1 includes a compressor housing 10 comprising a front end plate 11 which is, for example, formed of aluminum or aluminum alloy, and a cup shaped portion 12 which is formed of a press worked steel plate or aluminum die castings. Cup shaped portion 12 is disposed to one side surface of front end plate 11. An opening 111 is formed in center of front end plate 11 for penetration by a drive shaft 13. An annular projection 112 is formed in rear end surface of front end plate 11 which faces cup shaped portion 12, and projects concentric with opening 111. Cup shaped portion 12 has a flange portion 121 which extends radially outward along an opening portion thereof. An outer peripheral surface of annular projection 112 bites into an inner wall of the opening portion of cup shaped portion 12. The end surface of flange portion 121 fits against the rear end surface of front end plate 11 and is fixed to front end plate 11 by a fastening means, for example, bolts-nuts. The opening portion of cup shaped portion 12 is thereby covered by front end plate 11. An O-ring member 14 is placed between front end plate 11 and flange portion 121 of cup shaped portion 12, to thereby secure a seal between the fitting or mating surfaces of the front end plate 11 and the cup shaped portion 12. However, O-ring member 14 is not necessarily disposed between flange portion 121 of cup shaped portion 12 and front end plate 11, it may be disposed between the outer surface of annular projection 112 of front end plate 11 and the inner surface of cup shaped portion 12. Front end plate 11 has an annular sleeve portion 17 projecting from the front end surface thereof for surrounding drive shaft 13. In this embodiment as shown in FIG. 1, sleeve portion 17 is formed of steel and is separate from front end plate 11. Therefore, sleeve portion 17 is fixed to the front end surface of front end plate 11 by screws 18, one of which is shown in FIG. 1. Alternatively, the sleeve portion 17 may be formed integral with front end plate 11.

Drive shaft 13 is rotatably supported by sleeve portion 17 through a bearing means disposed within the front end portion of sleeve portion 17. Drive shaft 13 is formed with a disk rotor 15 at its inner end portion, and disk portion 15 is rotatably supported by front end plate 11 through a bearing means 16 disposed within an inner peripheral surface of annular projection 112. Therefore, drive shaft 13 is rotatably supported by the two bearing means, 16, 19. A shaft seal assembly 20 is assembled on drive shaft 13 within opening 111 of front end plate 11.

A pulley 22 is rotatably supported by a bearing means 21 which is disposed on outer surface of sleeve portion 17. An electromagnetic annular coil 23 is fixed to the outer surface of sleeve portion 17 by a support plate 159 and is received in an annular cavity 160 of pulley 22. An armature plate 24 is elastically supported on the outer end of drive shaft 13 which extends from sleeve portion 17. A magnetic clutch comprising pulley 22, magnetic coil 23 and armature plate 24 is thereby formed. Thus, drive shaft 13 is driven by an external drive power source, for example, a motor of a vehicle, through a rotation force transmitting means such as the magnetic clutch.

A fixed scroll member 25, an orbiting scroll member 26, a driving mechanism or orbiting scroll member 26 and a rotation preventing/thrust bearing means of orbiting scroll member 26 are disposed in an inner chamber of cup shaped portion 12. The inner chamber is formed between inner wall of cup shaped portion 12 and front end plate 11.

Fixed scroll member 25 includes a circular end plate 251 and a wrap means or spiral elements 252 affixed to or extending from one major side surface of circular plate 251. Circular plate 251 of fixed scroll member 25 is formed with a plurality of legs 253 axially projecting from a major end surface opposite to the side of the plate 251 from which spiral element 252 extend or are affixed. In the embodiment of this invention shown in FIG. 2, a wall portion 257 is formed in the area between of each leg 253 for reinforcement of legs 253. The wall portions 257 have cut-outs or bores 259 formed along their periphery to provide communication between the area radially inward of the wall portions 257 and the area radially outward of the wall portions 257. The legs 253 in combination with the wall portions 257 thus form generally annular member disposed between the circular end plate 251 and the inner surface of cup shaped member 12.

Figure 2:
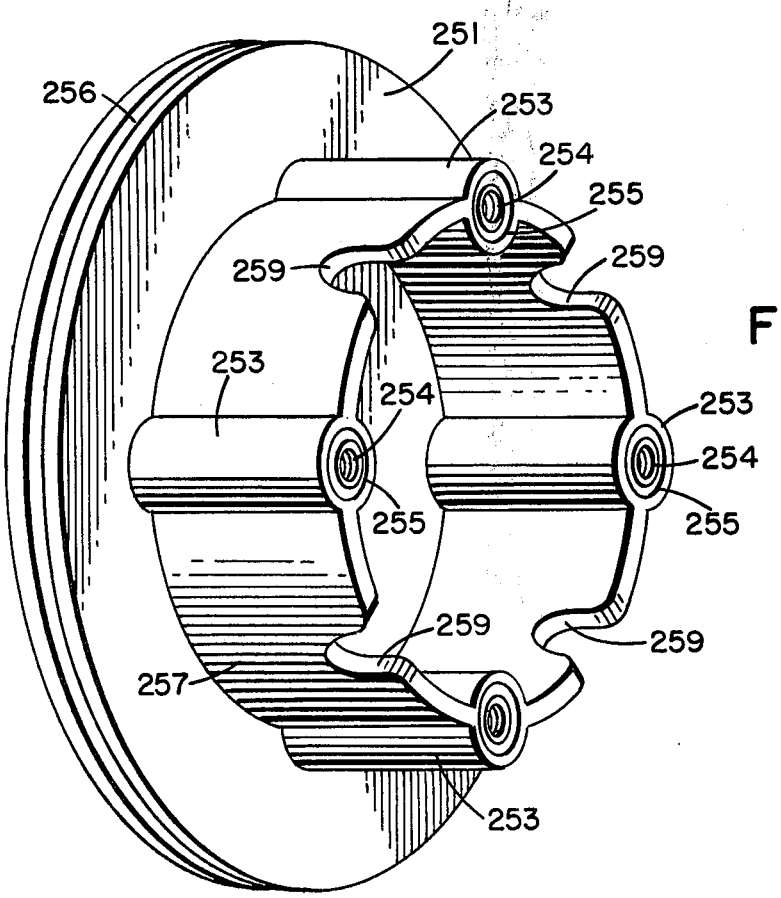
FIG. 2 is a perspective view of the fixed scroll member in the embodiment of FIG. 1.

An end surface of each leg 253 is fitted against the inner surface of a bottom plate portion 122 of cup shaped portion 12 and fixed to bottom plate portion 122 of cup shaped portion 12 by a screws 27 which screw into legs 253 from the outside of bottom plate portion 122. A first sealing member 28 are disposed between the end surface of each leg 253 and the inner surface of bottom plate portion 122, to thereby prevent fluid leakage along screws 27. Referring to FIG. 2, an annular groove 255 for receiving sealing member 28 and a tapped hole 254 for receiving screw 27 are formed on the end surface of each leg 253. A groove 256 is formed on the outer peripheral surface of circular plate 251 and a second seal ring member 29 is disposed therein to form a seal between the inner surface of cup shaped portion 12 and the outer peripheral portion or surface of circular plate 251. Thus, the inner chamber of cup shaped portion 12 is partitioned into two chambers by circular plate 251, such as a rear chamber 30 in which legs 253 are disposed and a front chamber 31 in which spiral element 251 of fixed scroll member 25 is disposed.

The axial projection of end plate 251 is not necessarily formed of legs 253 it may be formed of an annular projection, with a plurality of holes formed in the annular projection for receiving screw members at its end surface, and having a bore through the peripheral surface of the annular projection for communication to an outlet radially outward of the annular projection. Further, the legs or annular projection may be formed integral with the cup shaped portion rather than with the circular end plate.

Cup shaped portion 12 is provided with a fluid inlet port 35 and a fluid outlet port 36, which respectively are connected to the front and rear chambers 31, 30. A hole or discharge port 258 is formed through the circular plate 251 at a position near to the center of spiral element 252 and is connected to the fluid pocket of the spiral element center and rear chamber 30.

Orbiting scroll member 26 is disposed in front chamber 31. Orbiting scroll member 26 also comprises a circular end plate 261 and a wrap means or spiral element 262 affixed to or extending from one side surface of circular end plate 261. Spiral element 262 and spiral element 252 of fixed scroll member 25 interfit at angular offset of 180° and a predetermined radial offset. A pair of fluid pockets are thereby defined between spiral elements 252, 262. Orbiting scroll member 26 is connected to the drive mechanism and to the rotation preventing/thrust bearing mechanism. These last two mechanisms effect orbital motion of the orbiting scroll member 26 at a circular radius Ro by rotation of drive shaft 13, to thereby compress fluid passing through the compressor unit.

Generally, radius Ro of orbital motion given by $$\frac{\text{(pitch of spiral element)} - 2\text{(wall thickness of spiral element)}}{2}$$

As seen in FIG. 6, the pitch (P) of the spiral elements can be defined by $2\pi r_g$, where $r_g$ is the involute generating circle radius. The radius of orbital motion Ro is also illustrated in FIG. 6 as a locus of an arbitrary point Q on orbiting scroll member 26. The spiral element 262 is placed radially offset from spiral element 252 of fixed scroll member 25 by the distance Ro. Thereby, orbiting scroll member 26 is allowed to undergo the orbital motion of a radius Ro by the rotation of drive shaft 13. As the orbiting scroll member 26 orbits, line contact between both spiral elements 252 and 262 shifts to the center of the spiral elements along the surface of the spiral elements. Fluid pockets defined between spiral elements 252 and 262 move to the center with a consequent reduction of volume, to thereby compress the fluid in the pockets. Fluid inlet port 35 which is formed in cup shaped portion 12 is connected to the front chamber 31 and fluid outlet port 36 which is formed on cup shaped portion 12 is connected to rear chamber 30. Therefore, fluid, or refrigerant gas, introduced into front chamber 31 from an external fluid circuit through inlet port 35, is taken into fluid pockets formed between both spiral elements 252 and 262 from outer end portion of the spiral elements. As scroll member 26 orbits, fluid in the fluid pockets is compressed and the compressed fluid is discharged into rear chamber 30 from the fluid pocket of the spiral element center through hole 258, and therefrom, discharged through an outlet port 36 to the external fluid circuit, for example, a cooling circuit.

Figure 3:
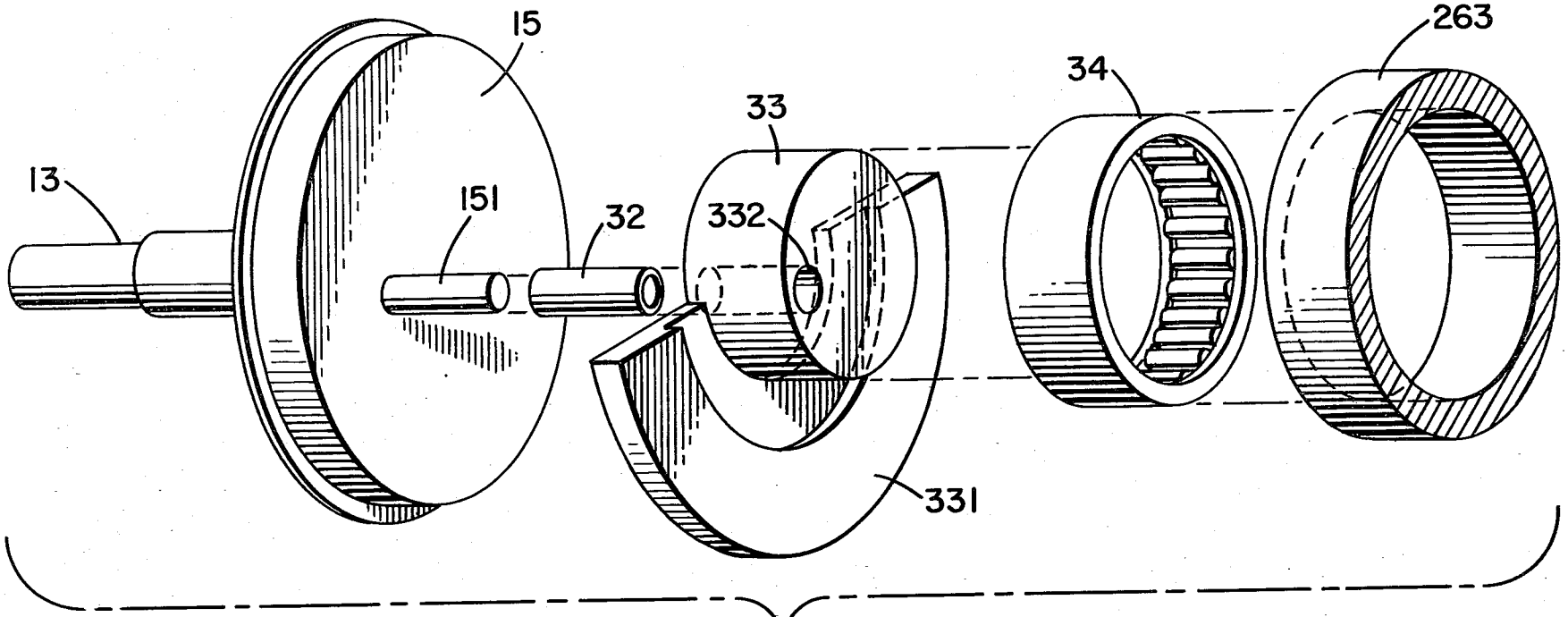
FIG. 3 is an exploded perspective view of the driving mechanism in the embodiment of FIG. 1.

Referring to FIGS. 1 and 3, the driving mechanism of orbiting scroll member 26 will be described. Drive shaft 13, which is rotatably supported by sleeve portion 17 through bearing mean, such as ball bearing 19, is formed with a disk rotor 15. Disk rotor 15 is rotatably supported by front end plate 11 through bearing means, such as ball bearing 16 disposed in the inner peripheral surface of annular projection 112.

A crank pin or drive pin 151 projects axially from an end surface of disk rotor 15 and, hence, from an end of drive shaft 13, and is radially offset from the center of drive shaft 13. Circular plate 261 of orbiting scroll member 26 is provided with a tubular boss 263 axially projecting from an end surface opposite to the side thereof from which spiral element 262 extends or is affixed. A discoid or short axial bushing 33 is fitted into boss 263, and is rotatably supported therein by bearing means, such as a needle bearing 34. Bushing 33 has a balance weight 331 which is shaped as a portion of a disk or ring and extends radially from bushing 33 along a front surface thereof. An eccentric hole 332 is formed in bushing 33 radially offset from center of bushing 33. Drive pin 151 is fitted into the eccentrically disposed hole 332 within which a bearing 32 may be applied. Bushing 33 is therefore driven by the revolution of drive pin 151 are permitted to rotate by needle bearing 34.

Respective placement of center Os of drive shaft 13, center Oc of bushing 33, and center Od of hole 332 and thus of drive pin 151, is shown in FIG. 4. In the position shown in FIG. 4, the distance between Os and Oc is the radius Ro of orbital motion, and when drive pin 151 is placed in eccentric hole 332, center Od of drive pin 151 is placed, with respect to Os, on the opposite side of a line L1, which is through Oc and perpendicular to a line L2 through Oc and Os, and also beyond the line through Oc and Os in direction of rotation A of drive shaft 13.

In this construction of a driving mechanism, center Oc of bushing 33 is permitted to swing about the center Od of drive pin 151 at a radius $E_2$, as shown in FIG. 4. Such swing motion of center Oc is illustrated as arc Oc'-Oc" in FIG. 4. This permitted swing motion allows the orbiting scroll member 26 to compensate its motion for changes in Ro due to wear on the spiral elements 252, 262 or due to other dimentional inaccuracies of the spiral elements. When drive shaft 13 rotates, a drive force is exerted at center Od to the left, and a reaction force of gas compression appears at center Oc to the right, both forced being parallel to line L1. Therefore, the arm Od-Oc swing outwardly by creation of the moment generated by the two forces. Spiral element 262 of orbiting scroll member 26 is thereby forced toward spiral element 252 of fixed scroll member 25 and the center of orbiting scroll member 26 orbits with the radius Ro around center Os of drive shaft 13. The rotation of orbiting scroll member 26 is prevented by a rotation preventing/thrust bearing mechanism, described more fully hereinafter, whereby orbiting scroll member 26 only orbits while maintaining its angular orientation. The fluid pockets move because of the orbital motion of orbiting scroll member 26, to thereby compress the fluid.

Figure 5:
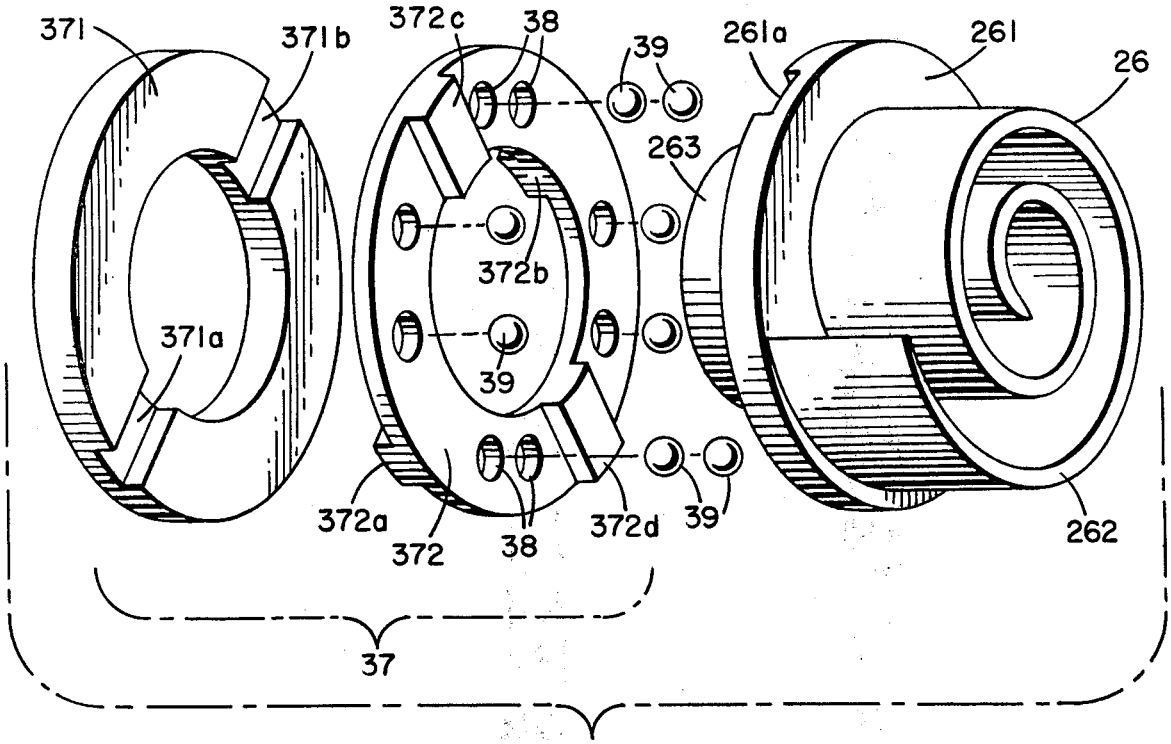
FIG. 5 is a perspective view of a rotation preventing mechanism in the embodiment of FIG. 1.

Referring to FIG. 5 and FIG. 1, a rotation preventing/thrust bearing, means 37 will be described. Rotation preventing/thrust bearing means 37 is disposed to surround boss 263 and is comprised of a fixed ring 371 and a sliding ring 372. Fixed ring 371 is secured to an end surface of annular projection 112 of front end plate 11 by pin 373, one of which is shown in FIG. 1. Fixed ring 371 is provided with a pair of keyways 371*a* and 371*b* in an axial end surface facing orbiting scroll member 26. Sliding ring 372 is disposed in a hollow space between fixed ring 371 and circular plate 261 of orbiting scroll member 26. Sliding ring 372 is provided with a pair of keys 372*a* and 372*b* on the surface facing fixed ring 371, which are received in keyways 371*a* and 371*b*. Therefore, sliding ring 372 is slidable in the radial direction by the guide of keys 372*a* and 372*b* within keyways 371*a* and 371*b*. Sliding ring 372 is also provided with a pair of keys 372*c* and 372*d* on its opposite surface. Keys 372*c* and 372*d* are arranged along a diameter perpendicular to the diameter along which keys 372*a* and 372*b* are arranged. Circular plate 261 of orbiting scroll member 26 is provided with a pair of keyways (in FIG. 5 only one of keyway 261*a* is shown, the other keyway is disposed diametrical opposite to keyway 261*a*) on a surface facing sliding ring 272 in which are received keys 372*c* and 372*d*. Therefore, orbiting scroll member 26 is slidable in a radial direction by guide of keys 372*c* and 372*d* within the keyways of circular plate 261.

Accordingly, orbiting scroll member 26 is slidable in one radial direction with sliding ring 372, and is slidable in another radial direction independently. The second sliding direction is perpendicular to the first radial direction. Therefore, orbiting scroll member 26 is prevented from rotating, but is permitted to move in two radial directions perpendicular to one another.

In addition, sliding ring 372 is provided with a plurality of pockets or holes 38 which are formed in an axial direction. A bearing means, such as balls 39, each having a diameter which is larger than the thickness of sliding ring 372, are retained in pockets 38. Balls 39 contact and roll on the surfaces of fixed ring 371 and circular plate 261. Therefore, the thrust load from orbiting scroll member 26 is supported on fixed ring 371 through balls 39.

The invention has been described in detail in connection with preferred embodiments, but these are examples only and this invention is not restricted thereto. It will be easily understood by those skilled in the art that the other variations and modifications can be easily made within the scope of this invention.

I claim:

1. In a scroll-type fluid displacement apparatus including a housing having a front end plate member with an end surface, a fixed scroll member fixedly disposed within said housing and having a first circular end plate from which a first wrap extends, an orbiting scroll member having a second end plate from which a second wrap extends and said first and second wraps interfitting at an angular offset to make a plurality of line contacts to define at least one pair of sealed off fluid pockets, and a driving means including a drive shaft which penetrates said front end plate member and is rotatably supported thereby for effecting the orbital motion of said orbiting scroll member by the rotation of said drive shaft while the rotation of said orbiting scroll member is prevented, whereby said fluid pockets change volume by the orbital motion of said orbiting scroll member, the improvement comprising said housing comprises a cup shaped casing with an inner cylindrical surface and said front end plate member having an annular the improvement comprising said housing comprises a cup shaped casing with an inner cylindrical surface and said front end plate member having an annular projection extending from said end surface thereof and facing an opening in said cup shaped casing, said cup shaped casing being received about said first and second end plates and said annular projection with its inner surface in fitting engagement about the peripheral surface of said first circular end plate and the peripheral surface of said annular projection, and said fixed scroll member fixedly held within the interior of said cup shaped casing by a plurality of screw members screwed from the outside of said cup shaped casing into a fixed member formed integral with said end plate and which is disposed between the end surface of said first end plate which is opposite to the side thereof from which said first wrap extends and the inner surface of said cup shaped casing.

2. The improvement as claimed in claim 1, wherein said cup shaped casing is formed with a flange portion at an opening portion thereof for fitting against the end surface of said front end plate member.

3. The improvement as claimed in claim 2, wherein an O-ring is disposed between the end surface of said front end plate member and the flange portion of said cup shaped casing.

4. The improvement as claimed in claim 2, wherein an O-ring is disposed between the outer surface of said annular projection and the inner surface of said cup shaped casing.

5. The improvement as claimed in claim 1, wherein a plurality of tapped holes are formed in said fixed member at its end surface for receiving said screw members.

6. The improvement as claimed in claim 5, wherein said fixed member comprises a plurality of legs.

7. The improvement as claimed in claim 5, wherein said fixed member comprises an annular wall, and at least one connecting bore is formed through a peripheral surface of said annular wall.

8. The improvement as claimed in claim 1, wherein a first seal ring means is disposed about said screw members.

9. The improvement as claimed in claim 1 or 8, wherein a second seal ring member is disposed between an outer peripheral surface of said first end plate and the inner surface of said cup shaped casing, whereby an inner chamber of said cup shaped casing is partitioned into two chambers by said first end plate.

10. The improvement as claimed in claim 9, wherein one of the chambers contains said first wrap, orbiting scroll member and driving means and the other of said chambers contains said fixed member.

11. The improvement as claimed in claim 9, wherein said cup shaped casing is provided with a fluid inlet port and a fluid outlet port.

12. The improvement as claimed in claim 10, wherein said fluid inlet port is connected to the one chamber and said fluid outlet port connected to the other chamber, whereby said apparatus operates as a compressor.

13. A scroll-type fluid displacement apparatus comprising:

a housing comprising a cup shaped casing and a front end plate, said cup shaped casing having a cylindrical inner surface and said front end plate having an end surface facing said cup shaped casing with an annular projection extending therefrom;

a fixed scroll member fixedly disposed within said housing and having a first circular end plate from which a first wrap extends;

said cup shaped casing being received about said first circular end plate and said annular projection with its inner surface in fitting engagement about a peripheral surface of said first circular end plate and a peripheral surface of said annular projection;

a fixed member with a plurality of legs being formed integral with said first circular end plate at an end surface opposite to the side thereof from which said first wrap extends, and fixed at the inner surface of said cup shaped casing by screws, whereby said fixed scroll member is fixedly held within said housing;

an orbiting scroll member movably disposed within said housing and having a second end plate from which a second wrap extends;

driving means including a drive shaft which penetrates said front end plate and is rotatably supported by said front end plate, said driving means being connected to said orbiting scroll member for transmitting orbital motion to said orbiting scroll member and preventing rotation of said orbiting scroll member;

a first seal ring member being disposed between each end surface of each of said legs and the inner surface of said casing; and a second seal ring being disposed between the outer peripheral surface of said first end plate and the inner surface of said casing.

14. The scroll-type fluid displacement apparatus as claimed in claim 13, wherein said cup shaped casing is formed with a flange portion at an opening portion thereof, and said flange portion being fixed to the end surface of said front end plate member by fasteners.

15. The scroll-type fluid displacement apparatus as claimed in claim 14, wherein an O-ring is disposed on a contact surface between the end surface of said front end plate and said flange portion of said cup shaped casing.

* * * * *

UNITED STATES PATENT AND TRADEMARK OFFICE

CERTIFICATE OF CORRECTION

PATENT NO. : 4,411,604

DATED : October 25, 1983

INVENTOR(S) : Kiyoshi Terauchi

It is certified that error appears in the above—identified patent and that said Letters Patent is hereby corrected as shown below:

In Claim 1, Col. 7, lines 29-32, delete "having an annular the improvement comprising said housing comprises a cup shaped casing with an inner cylindrical surface and said front end plate member".

Signed and Sealed this

*Twelfth* Day of *June 1984*

[SEAL]

*Attest:*

GERALD J. MOSSINGHOFF

*Attesting Officer*

*Commissioner of Patents and Trademarks*